US009446887B2

(12) United States Patent
Jacobson et al.

(10) Patent No.: US 9,446,887 B2
(45) Date of Patent: Sep. 20, 2016

(54) NECK EXTENDER AND GRIP PROMOTING DEVICES AND SYSTEMS

(71) Applicants: Devin Jacobson, Dallas, TX (US); Shawn Egerton, Garland, TX (US)

(72) Inventors: Devin Jacobson, Dallas, TX (US); Shawn Egerton, Garland, TX (US)

( * ) Notice: Subject to any disclaimer, the term of this patent is extended or adjusted under 35 U.S.C. 154(b) by 0 days.

(21) Appl. No.: 14/476,677

(22) Filed: Sep. 3, 2014

(65) Prior Publication Data

US 2014/0367416 A1 Dec. 18, 2014

Related U.S. Application Data

(63) Continuation-in-part of application No. 13/332,829, filed on Dec. 21, 2011, now abandoned.

(51) Int. Cl.

| | |
|---|---|
| ***B67D 3/00*** | (2006.01) |
| ***B67D 7/06*** | (2010.01) |
| ***B65D 47/06*** | (2006.01) |
| ***B65D 23/08*** | (2006.01) |

(52) U.S. Cl.
CPC ..... *B65D 47/06* (2013.01); *B65D 23/08* (2013.01)

(58) Field of Classification Search
CPC ..... B65D 47/06; B65D 23/08
USPC ..... 222/530
See application file for complete search history.

(56) References Cited

U.S. PATENT DOCUMENTS

| | | | | |
|---|---|---|---|---|
| 4,793,339 | A | 12/1988 | Matsumoto et al. | |
| 4,938,395 | A * | 7/1990 | Jamieson | B65D 47/06 215/387 |
| 5,072,861 | A | 12/1991 | Jou | |
| 5,722,570 | A * | 3/1998 | Sultzer, III | B65D 47/063 222/529 |
| 6,568,660 | B1 * | 5/2003 | Flanbaum | B65D 47/06 222/189.07 |
| 6,742,678 | B1 | 6/2004 | Krystopik, Jr. | |
| 6,955,492 | B1 * | 10/2005 | Huang | A45D 34/043 222/567 |
| 7,185,775 | B1 | 3/2007 | Decal | |
| 7,527,180 | B2 | 5/2009 | Allen et al. | |
| 7,658,306 | B2 | 2/2010 | Allen et al. | |
| 2003/0226860 | A1 | 12/2003 | Godwin et al. | |
| 2006/0131255 | A1 | 6/2006 | Blondeel | |
| 2008/0073383 | A1 | 3/2008 | McDonald | |
| 2009/0283494 | A1 | 11/2009 | Maxwell | |
| 2010/0294379 | A1 | 11/2010 | Erdmann | |
| 2011/0036873 | A1 | 2/2011 | Peckels | |
| 2011/0147405 | A1 | 6/2011 | Blin | |
| 2012/0085790 | A1 | 4/2012 | Agassi et al. | |
| 2012/0211516 | A1 | 8/2012 | Zapp et al. | |
| 2013/0153685 | A1 | 6/2013 | Michael et al. | |

* cited by examiner

*Primary Examiner* — Patrick M Buechner
*Assistant Examiner* — Jeremy W Carroll
(74) *Attorney, Agent, or Firm* — Reichel Stohry LLP; Natalie J. Dean; Mark C. Reichel

(57) ABSTRACT

Devices and systems for facilitating a user's grip around the neck of a bottle such that the contents of the bottle may be poured quickly and efficiently, with minimal stress on the use's body. Furthermore, such systems and methods may be configured to extend the neck of a bottle such that an attached pour spout is positioned at a desired height. Such a device may comprise a body to couple with the neck of the bottle, the body having an exterior surface configured to facilitate a secure grip therearound.

19 Claims, 6 Drawing Sheets

Figure 2
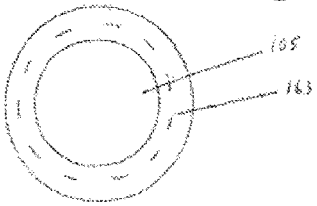
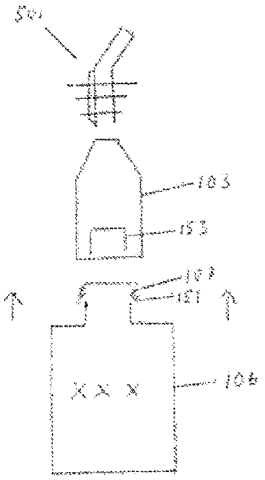
Figure 5
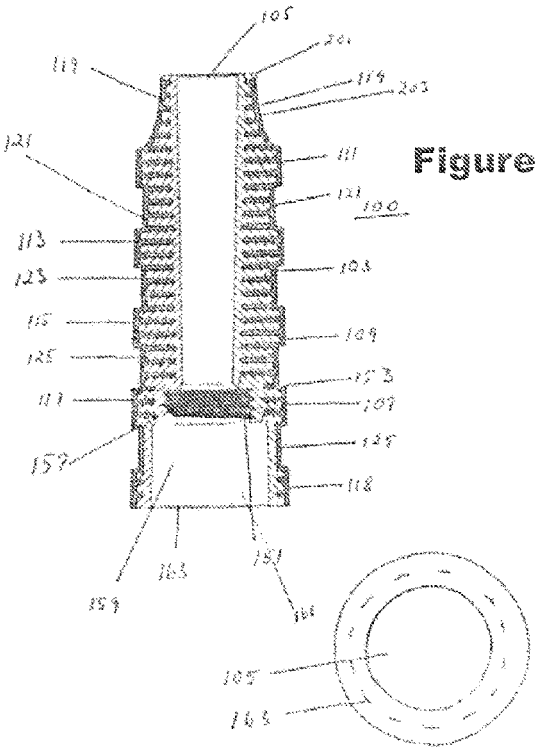
Figure 1
Figure 3

NECK EXTENDER AND GRIP PROMOTING DEVICES AND SYSTEMS

PRIORITY CLAIM

This application is related to and claims the priority benefit of U.S. patent application Ser. No. 13/332,829 to Jacobson et al., filed Dec. 21, 2011, which is currently co-pending herewith. The content of the foregoing application is hereby incorporated by reference in its entirety into this disclosure as if fully set forth herein.

BACKGROUND

Pour spouts for dispensing liquids are well known in the art. Such spouts can be commonly found in taverns and pubs where large amounts of liquor are dispensed from various sized bottles through the general course of business. During busy periods, a bar tender is often required to pour and mix drinks quickly in order to efficiently serve the patrons of the establishment. In addition to speed, accuracy is also important. It is undesirable that liquor is wasted through spillage or by dispensing excessive amounts of liquor into individual drinks. A pour spout inserted into the neck of a liquor bottle allows the fluid contents of the bottle to be poured out quickly and smoothly, in controlled manner. With a properly designed pour spout, the fluid contents of a bottle are dispensed in a narrow continuous stream, without the characteristic backing up of liquid in the throat of the bottle as is common when liquids are poured too quickly from bottles not fitted with a pour spout.

A typical pour spout including features common to most models is disclosed in U.S. Pat. No. 3,966,099 issued to Sanford, Jr. et al. There, a pour spout is disclosed including a lower portion which is insertable into the neck of a bottle; a vent tube; a spout; and a horizontal disc separating the lower insertable portion from the external spout portion. The lower insertable portion includes a plurality of resilient sealing fins which engage the internal surface of the bottle neck when the pour spout is inserted therein, forming a liquid tight seal which prevents fluid from leaking out of the bottle around the outer surfaces of the pour spout. A channel or bore is formed within the spout portion, and extends through the entire pour spout. Apertures at either end of the channel allow liquid to enter the lower portion of the pour spout inserted into the bottle neck, and be poured out through the aperture in the spout at the opposite end. The vent tube extends through the lower insertable portion of the pour spout and includes a second narrow bore. The second bore extends only as far as the horizontal surface of the disc, where a small aperture opens to the external environment surrounding the pour spot and bottle. When the contents of the bottle are to be poured out, the bottle is tipped from a vertical position toward a more horizontal orientation. The external spout portion is angled such that to pour the contents of the bottle, the bottle must be tipped in the same direction as the angle of the spout. This ensures that the fluid contents of the bottle will properly enter the pouring channel without requiring excessive tipping of the bottle. As the liquid is dispensed out of the bottle through the spout, the vent tube allows air to enter the bottle, equalizing the pressure within the bottle and preventing the contents of the bottle from backing up and pouring out in an uneven manner. While there have been innumerable variations to the basic design just described, these basic features are common to most, if not all, presently used beverage pour spouts.

As noted, pour spouts such as that disclosed in the U.S. Pat. No. 3,966,099 patent are typically used by taverns and pubs and other purveyors liquors and spirits. The bottles in which such pour spouts are most often inserted are bottles containing liquor of one kind or another, such as whiskey, gin, vodka, and others. Generally most liquor dispensing establishments will have an entire assortment of liquor bottles lined up behind the bar, each opened, and each having a pour spout inserted into the neck thereof. Thus, in the crush of business, a bar tender need only reach for a particular bottle and quickly pour a controlled volume of liquid into a glass in order to mix a particular drink requested by a patron. Having pour spouts in all of the bottles greatly increases the bar tender's efficiency, and cuts down on excess spillage and over filling of drinks.

The weight distribution in most conventional bottles is uneven along its length due to the liquid therein gravitating towards the bottom of the bottle (i.e. most bottles containing liquid are bottom-heavy). As such, when a user grasps and tilts the bottle to pour the liquid therefrom (grasping either the neck or body of the bottle), strain can result on the user's wrist, hand and back as the user bears the weight of the bottle and subsequently manages its weight redistribution as the liquid shifts during the pour. Furthermore, dimly lit taverns make it difficult to identify the bottle, and a misidentification of the bottle may result in the drink being improperly prepared. Lastly, different sized bottles makes it difficult to quickly and efficiently grasp the correct bottle and dispense the drinks properly. Still further, many conventional bottles have short necks and/or large diameters making them inconvenient to grasp and pour with one hand, and further exacerbating the strain placed on a user's wrist, hand and back.

Additionally, conventional bottles do not have a standard size, but rather come in many different shapes, sizes and configurations. As such, in a setting such as a bar where multiple bottles are lined up next to each other, the height at which a user must grasp each bottle varies. Because of this, selecting the correct bottle and securely grasping the same without knocking the adjacent bottles over takes valuable time and results in an inefficient process.

What is needed is a device which can be coupled with the neck of a fluid containing vessel that facilitates a user's grasp of the bottle while allowing the liquid contents of the vessel to be poured in a smooth and controlled manner. Furthermore, such a device should be easily manufactured and inexpensive to produce. Preferably, the device should be made of plastic by injection molding. Additionally, a system is needed for standardizing the grip component and height thereof when a variety of bottles are positioned adjacent to one another, such as in a bar or restaurant setting.

BRIEF SUMMARY

In at least one exemplary embodiment of a neck extender and grip promoting device of the present disclosure, the device comprises a body having a first end, a second end, a central aperture extending from the first end to the second open end, and an exterior surface. The exterior surface of the body comprises a grip portion configured to facilitate a secure grip of a hand therearound in support of pouring fluid from a container. Furthermore, the second end of the body is configured to couple with a pour spout. The first end of the body is configured to receive a neck of the container and comprises a first wider aperture having a diameter greater than the central aperture and at least one female thread to cooperate with a male thread of the container.

The grip portion of the device may be configured in a variety of ways and may be a separate component that is attached to or coupled with the body, or be an integral component of the body itself. In at least one exemplary embodiment, the grip portion of the neck extender and grip promoting device comprises a first rib and a first depression, the first depression having a curved surface and extending from the first rib to the second end of the body. Furthermore, in at least one embodiment, the second end of the body is configured to removably couple with a pour spout. The grip portion may further comprise a second rib. Still further, the grip portion may further comprise a second depression positioned between the first rib and the second rib. Additionally or alternatively, the grip portion may further comprise a third rib and a third depression, the third depression positioned between the second rib and the third rib. In yet another embodiment, the grip portion may additionally comprise a fourth rib and a fourth depression, the fourth depression positioned between the third rib and the fourth rib.

Additionally or alternatively, the grip portion of the neck extender and grip promoting device may comprise one or more ribs, each rib extending radially from the periphery of the body. For example, in at least one exemplary embodiment, the grip portion may comprise two or more ribs and two or more depressions. In this embodiment, each rib extends radially from the periphery of the body and each depression comprises a curved surface and is positioned adjacent to at least one of the ribs. Additionally, in an optional embodiment, one of the depressions is positioned around the periphery of the body and extends from a first rib to the second end of the body.

The grip portion of the neck extender and grip promoting device may additionally or alternatively comprise a pattern of raised surfaces. Indeed, such a pattern may comprise a knurled pattern, a honeycomb pattern, a diamond pattern, a rib-firmed pattern, or a combination of any of the aforementioned. Alternatively, the exterior surface of the body may comprise a tapered configuration such that the radial diameter of the second end is greater than the radial diameter of the first end. In such embodiments, the grip portion need not comprise a raised surface comprising patterns or ribs at all, but instead may be smooth.

In at least one exemplary embodiment, the grip portion of the neck extender and grip promoting device comprises a compressible material. Such a compressible material may be foam rubber, sponge rubber, synthetic rubber, plastic foam or the like. Furthermore, the container to which the neck extender and grip promoting device is configured to couple may comprise a glass bottle, with the fluid contained therein being, a liquor.

In at least one exemplary embodiment of a system for obtaining uniform container heights of the present disclosure, the system comprises two or more containers for holding fluid and two or more neck extender and grip promoting devices. Here, each of the containers comprises a height and at least two of the containers have different heights and/or sizes. Furthermore, each of the neck extender and grip promoting devices comprises a first end configured to couple with at least one of the two or more containers, a second end configured to couple with a pour spout, and a body configured to facilitate a secure grip around the device. The body additionally comprises a central aperture and a first wider aperture having a diameter greater than the central aperture and includes at least one female thread to cooperate with a male thread of the container. Furthermore, the neck extender and grip promoting devices of the system are each configured to have a height corresponding with the at least one container to which it is configured to couple and, when each neck extender and grip promoting device is coupled with the corresponding container, the resulting extended containers all comprise a substantially uniform height. Furthermore, each of the two or more neck extender and grip promoting devices may comprise an indicium. In such embodiments, when each neck extender and grip promoting device is coupled with a container, the indicium of the neck extender and grip promoting device is indicative of the fluid held in such container. Additionally or alternatively, the system may comprise one or more containers without a neck extender and grip promoting device coupled therewith, each of such containers for holding fluid and comprising a height that is substantially equivalent to the uniform height.

Other exemplary embodiments of a neck extender and grip promoting device are disclosed. In such embodiments, the device comprises a first end configured to couple with the neck of a bottle, a second open end, and a body extending between the first and second ends. The body comprises a grip portion to facilitate a secure grip of a hand therearound in support of pouring fluid from the bottle, a central aperture in fluid communication with the first and second ends of the device, and a first wider aperture comprising at least one female thread to cooperate with a male thread of the bottle. Furthermore, the body is configured to support the bottle when the device is coupled with a bottle and the body is gripped and lifted. In at least one alternative embodiment, the body of the device may comprise a substantially cylindrical configuration and the grip portion may further comprise two or more ribs comprised of a compressible material.

BRIEF DESCRIPTION OF THE DRAWINGS

The disclosed embodiments and other features, advantages, and disclosures contained herein, and the manner of attaining them, will become apparent and the present disclosure will be better understood by reference to the following description of various exemplary embodiments of the present disclosure taken in conjunction with the accompanying drawings, wherein:

FIG. 1 illustrates a cross-sectional view of an exemplary embodiment of a neck extender device of the present disclosure;

FIG. 2 illustrates a top cross-sectional view of the neck extender device of the present disclosure;

FIG. 3 illustrates a bottom cross-sectional view of the neck extender device of the present disclosure;

FIG. 5 illustrates a cross-sectional view of a bottle and the neck extender device of the present disclosure;

Figure 4:
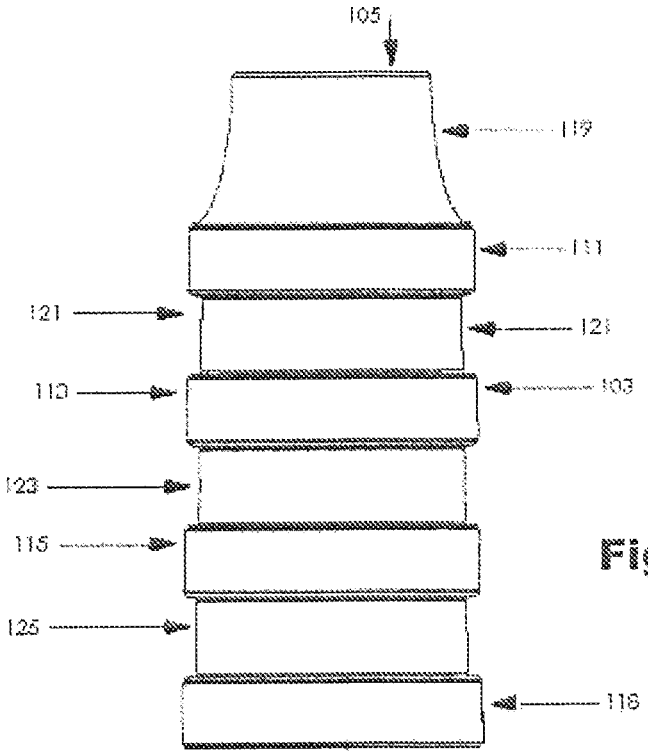
FIG. 4 illustrates a perspective view of an exemplary embodiment of a neck extender device of the present disclosure.

An overview of the features, functions of the devices and systems depicted in the various figures will now be presented. It should be appreciated that not all of the features of the devices and systems depicted in the figures are necessarily expressly described herein; rather, certain non-discussed features, such as various couplers, etc., as well as other discussed features are inherent from the figures and disclosure itself. Other non-discussed features may be inherent in component geometry and/or configuration.

DETAILED DESCRIPTION

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended, with any additional alterations and modifications and further applications of the principles of this disclosure being contemplated hereby as would normally occur to one skilled in the art.

The disclosure of the present application provides novel devices and systems for facilitating a user's grip around the neck of a bottle such that the contents of the bottle may be poured therefrom quickly and efficiently. Additionally, certain embodiments of the devices and systems described herein may be configured to extend the neck of a bottle to further facilitate a user's grip. Unlike conventional devices and systems, the devices and systems hereof are capable of being coupled with various bottle configurations such that a user to easily achieve a secure grasp of such bottles despite their varying configurations. Furthermore, the devices and systems hereof are durable and easy to apply and use. Because of these unique and advantageous properties, and as will be described herein in further detail, the devices and systems of the present disclosure are particularly well suited for use in restaurants and bars where time is of the essence and bartenders and/or those serving patrons need to be able to quickly and efficiently select between and pour from various different bottles over an extended period of time.

The present disclosure provides a device configured to couple with a neck of a bottle and facilitate a user's grip therearound. In at least one embodiment, the device is configured to extend the length of the neck of the bottle—for example a liquor bottle or other type of bottle—by coupling with both the neck of the bottle and, optionally, a pour spout in order to facilitate pouring the liquid from the bottle. Additionally or alternatively, where the underlying bottle comprises an elongated neck and/or extension of the bottle neck is not desired, the device may applied to the bottle such that it surrounds at least a portion of the neck, in such cases, the device hereof simply provides a grip for a user to easily and securely grasp and does not substantially extend the neck of the bottle.

The neck extender device of the present disclosure may be configured in different shapes and/or sizes in order to accommodate bottles of different configurations and sizes such that a uniform height may be achieved when the neck extender device has been placed on the bottles. In addition, the neck extender device of the present invention may be different colors or comprise different indicia in order to identify different flavors and/or the contents within the bottles.

FIG. 1 illustrates at least one embodiment of a neck portion 107 of a bottle 106 positioned within a neck extender device 100. Likewise, FIG. 4 shows at least one additional embodiment of the neck extender device 100 not attached to a bottle 106 or a pour spout.

The neck extender device 100 comprises a body 103 having a first end configured to receive the neck portion 107 of a bottle 106 and a second open. While the second open end can remain open, it may optionally be configured to cooperate with a pour spout (not shown in FIG. 1 or 4). Additionally, the body 103 of the neck extender device 100 comprises a central aperture 105 extending longitudinally through the body 103 from its first end to its second open end. Accordingly, when the neck extender device 100 is coupled with a bottle 106, the first end of the body 103 is in fluid communication with the opening 109 of the neck portion 107. In this manner, the neck extender device 100 can be grasped by a user and fluid can be poured from the bottle 106, through the central aperture 105 and out of the second open end. In those embodiments where the second end of the body 103 is coupled with a pour spout (see FIGS. 5 and 7-10), a user may utilize the device 100 to pour fluid from the bottle 106, through the central aperture 105 and out of the pour spout.

The body 103 of the neck extender device 100 may comprise any configuration, provided the exterior of the body 103 is comfortable for a user to securely grasp and the interior of the body 103 is configured to receive a bottle 106 within its first end. In at least one embodiment, the body 103 may be substantially cylindrical in nature and have a circular cross-section. Other cross-sections such as oval, rectangular or other cross-sections are also within the scope of the present disclosure.

As previously noted, the neck extender device 100 may be utilized with or without a pour spout. When a pour spout is desired (to meter flow from the underlying bottle 106, for example), the second end of the body 103 is configured to removably couple therewith in a manner that prevents leakage, but also facilitates the easy removal of the pour spout for cleaning or other purposes. For example, one or more gaskets or the like may be positioned in between the pour spout and the second end of the body 103. Alternatively, the second open end of the body 103 may directly receive the pour spout (such as, for example, where gaskets and/or similar components are integral to the pour spout itself or simply unnecessary). Still further, in at least one embodiment, a pour spout may be integral to the second end of the body 103 such that it is not removable therefrom.

The central aperture 105 of the body 103 may be connected to a first wider aperture 157 which may include female threads 153 to threadably connect to male threads 151 of the neck portion 107 and which may have a wider diameter than the central aperture 105. The first wider aperture 157 may be connected to a second wider aperture 159 and the second wider aperture 159 may have a wider diameter than the first wider aperture 157.

Now referring to the exterior of the neck extender device 100, the neck extender device 100 may include a configuration to facilitate a user's grip therearound. As shown in the embodiments of FIGS. 1 and 4, the neck extender device 100 may comprise a plurality of ribs or other patterns that provide raised surfaces on the exterior of the body 104. FIG. 1 depicts at least one embodiment of device 100 comprising a first rib 111, which extends radially around the periphery of the body 103, a second rib 113 which extends radially around the periphery of the body 103 and which is in a spaced relationship with the first rib 111, a third rib 115 which extends radially around the periphery of the body 103 and which is in a spaced relationship with the first rib 111 and the second rib 113, a fourth rib 117 which extends radially around the body 103 and which is in a spaced relationship with respect to the first rib 111, the second rib 113, the third rib 115 and a fifth rib 118 which extends radially around the body 103 and which is in a spaced relationship with respect to the first rib 111, the second rib 113, the third rib 115 and the fourth rib 117. The embodiment of the device 100 shown in FIG. 4 is similarly configured to that of FIG. 1; however, it will be noted that such illustrated embodiment only comprises four ribs—the first, second, third, and fifth 111, 113, 115, 118.

In at least the exemplary embodiments shown in FIGS. 1 and 4, the ribs aid in the support of the neck extender device 100 by providing raised surfaces to allow the user an improved grip. The neck extender device 100 of the present disclosure may eliminate or reduce the strain on the wrist, hand and back which may otherwise be caused by pouring drinks. For example, most conventional bottles have necks that are insufficient in length for a user to grasp with their entire hand. Because of this, in order to grasp a bottle and pour out its contents, a user must grasp the bottle neck with only a couple of fingers. This pinching or finger grip places an increased strain on the user's hand, wrist and forearm, as the weight of the bottle is born thereby. Furthermore, if the bottle is placed in a speed well or rack, a bartender or other user must necessarily bend over to grasp the bottle's short neck, which places additional strain on such user's back. The devices of the present disclosure provide adequate room for a user to grasp with the entire hand and also increase the height of the graspable surface such that a user does not need to bend or lean over to access a bottle.

In addition to the previously described ribs, the exterior surface of the body 103 may include a first depression 119 which may extend radially around the body 103 and may include a concave surface and may extend from the first rib 111 to the distal end of the body 103, a second depression 121 which may extend radially around the body 103 and which may be positioned between the first rib 111 and a second rib 113, a third depression 123 which may extend radially around the body 103 and which may be positioned between the second rib 113 and the third rib 115, a fourth depression 125 which may extend radially around the body 103 and which may be positioned between the third rib 115 and the fourth rib 117, a fifth depression 127 which may extend radially around the body 103 and which may be positioned between the fourth rib 117 and the fifth rib 118. Similar to the profile of first depression 119, the second, third, fourth, and fifth depressions 121, 123, 125, 127 may alternatively comprise a concave or curved surface (see the devices 100 applied to bottles **206*f* and 206*e* of FIGS. 9 and 10**).

While the embodiment of the neck extender device 100 shown in FIG. 1 comprises five ribs (111, 113, 115, 117, 118) and five depressions (119, 121, 123, 125, 127), and the embodiment shown in FIG. 4 comprises four ribs (111, 113, 115, 118) and four depressions (119, 121, 123, 125), it will be appreciated that the device 100 can comprise any number of ribs and corresponding depressions. Indeed, more or less ribs/depressions can be utilized depending on the desired size (i.e. length) of the body 103. Furthermore, while the ribs 111, 113, 115, 117, 118 and depressions 121, 123, 125, 127 of the Figures are depicted as having relatively flat/straight profiles and continuously extend around the periphery of the body 103, it will be appreciated that any rib or depression profile (or combination of profiles) conducive to facilitating a user's grip may be employed. For example, and without limitation, the ribs of the neck extender device 100 may comprise a rounded or curved configuration or, alternatively, a combination of rounded/curved ribs and relatively flat ribs may be used. Likewise, two or more of the depressions 119, 121, 123, 125, 127 may comprise concave or curved configurations. Additionally or alternatively, the ribs may be broken such that each rib (or at least one of the ribs) does not continuously extend around the periphery of the body 103, but instead provides broken raised surfaces to facilitate a user's grip.

Figure 6:
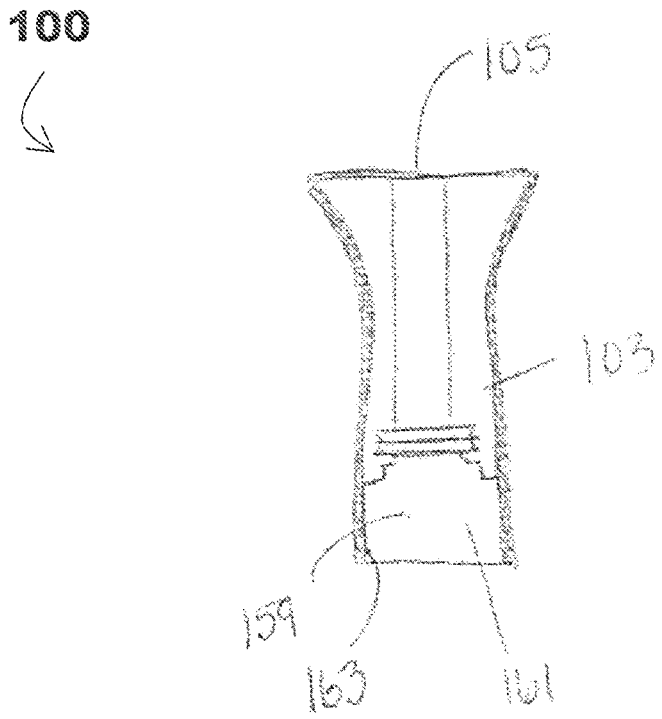
FIG. 6 shows a side, cross-sectional view of an additional embodiment of a neck extender device of the present disclosure.

Furthermore, the exterior surface of the neck extender device 100 need not even comprise a ribbed configuration as long as the exterior surface of the body 103 and/or its overall external configuration facilitates a user's secure grip therearound. For example, the exterior of the neck extender device 100 may comprise any grip pattern now known or hereinafter developed that facilitates the secure grip including, without limitation, a knurled grip, a diamond grip, a classic finger grip, a rib-finned grip, a honeycomb grip, etc. In at least one embodiment shown in cross-section in FIG. 6, the exterior surface of the neck extender device 100 may even be smooth (or patterned or ribbed, depending on preference), provided the body 103 is shaped in a tapered configuration with the second open end having a larger external diameter than the external diameter of the first end.

The body 103 maybe formed by extrusion and may be formed from a first material 201 which may be a relatively hard plastic material and may be positioned on the interior of the body 103 to form a base for the second material 203 and a second material 203 which may substantially cover the first material 203 and may be relatively softer than the first material 201 in order to aid in maintaining a secure grip on the body 103 and maybe flexible. In at least one embodiment, the second material 203 may comprise a relatively softer plastic compound and/or a compressible material, such as a foam rubber, sponge rubber, a synthetic rubber (such as Neoprene or polychloroprene) or plastic foam, to cushion the exterior of the body 103 and facilitate a secure grip.

FIG. 1 additionally illustrates that the neck portion 107 of the bottle 106 may include male threads 151 which may be used to seal the bottle 106 with a bottle lid (not shown) and alternatively can be threaded into the neck extender device 100 by cooperating with female threads 153 of a first portion 161 of the neck extender device which may define the first wider aperture 157. The second wider aperture 159 may be defined by a second portion 163 of the neck extender device 100. It will be appreciated that the specific dimensions of the female threads 153 of the neck extender device 100 may vary depending on the desired application of the device 100. For example, the female threads 153 may be configured to mate with male threads having specific thread gauges and/or types. In this manner, the neck extender device 100 may be configured to couple with different bottles and containers having varying sizes, shapes and dimensions. Alternatively, where a bottle 106 does not comprise threading on or near its opening 109, the first portion 161 and/or wider aperture 157 of the neck extender device 100 may be configured to slidably mate with the opening 109 of the bottle 106 such that the neck extender device 100 is sealed thereto. This may be achieved through the use of gaskets, rubber valves, and/or any other coupler known in the art.

FIG. 2 illustrates a top view of the neck extender device 100 which may include the central aperture 105 and the second portion 163.

FIG. 3 illustrates a bottom view the neck extender device 100 which may include the first portion 161 and the second portion 163.

FIG. 5 illustrates a neck portion 107 of a bottle being positioned within the neck extender device 100 (to cooperate with a pour spout) which may include a body 103 which may be a substantial cylinder having a circular cross-section. Other cross-sections such as oval, rectangular or other cross-sections are within the scope of the present invention. The body 103 may include a central aperture 105 which may extend in the longitudinal direction and which may extend through the body 103 in order to communicate with the opening 109 of the neck portion 107. The neck extender device 100 may include a first rib 111 which may extend radially around the periphery of the body 103, a second rib 113 which may extend radially around the periphery of the body 103 and which may be in a spaced relationship with the first rib 111, a third rib 115 which may extend radially around the periphery of the body 103 and which may be in a spaced relationship with the first rib 111 and the second rib 113, a fourth rib 117 which may extend radially around the body 103 and which may be in a spaced relationship with respect to the first rib 111, the second rib 113, the third rib 115 and the fifth rib 118 which may extend radially around the body 103 and which may be in a spaced relationship with respect to the first rib 111, the second rib 113, the third rib 115 and the fourth rib 117.

The surface of the body 103 may include a first depression 119 which may extend radially around the cylindrical body 103 and may include a concave surface and may extend from the first rib 111 to the distal end of the body 103, a second depression 121 which may extend radially around the body 103 and which may be positioned between the first rib 111 and a second rib 113, a third depression 123 which may extend radially around the body 103 and which may be positioned between the second rib 113 and the third rib 115, a third depression 123 which may extend radially around the cylindrical body 103 and which may be positioned between the third rib 115 and the fourth rib 117, a fourth depression 125 which may extend radially around the body 113 and which may be positioned between the fourth rib 117 and the fifth rib 118.

FIG. 5 further illustrates a bottle 106 having a neck 107 which may include male threads 151 which may cooperate with the female threads 153 of the body 103. FIG. 5 additionally illustrates a pour spout 501 which may be inserted into the second open end of the body 103 of the neck extender device 100 and which may be connected to the neck extender to by a friction fit or as may be otherwise known or hereinafter developed.

Figure 7:
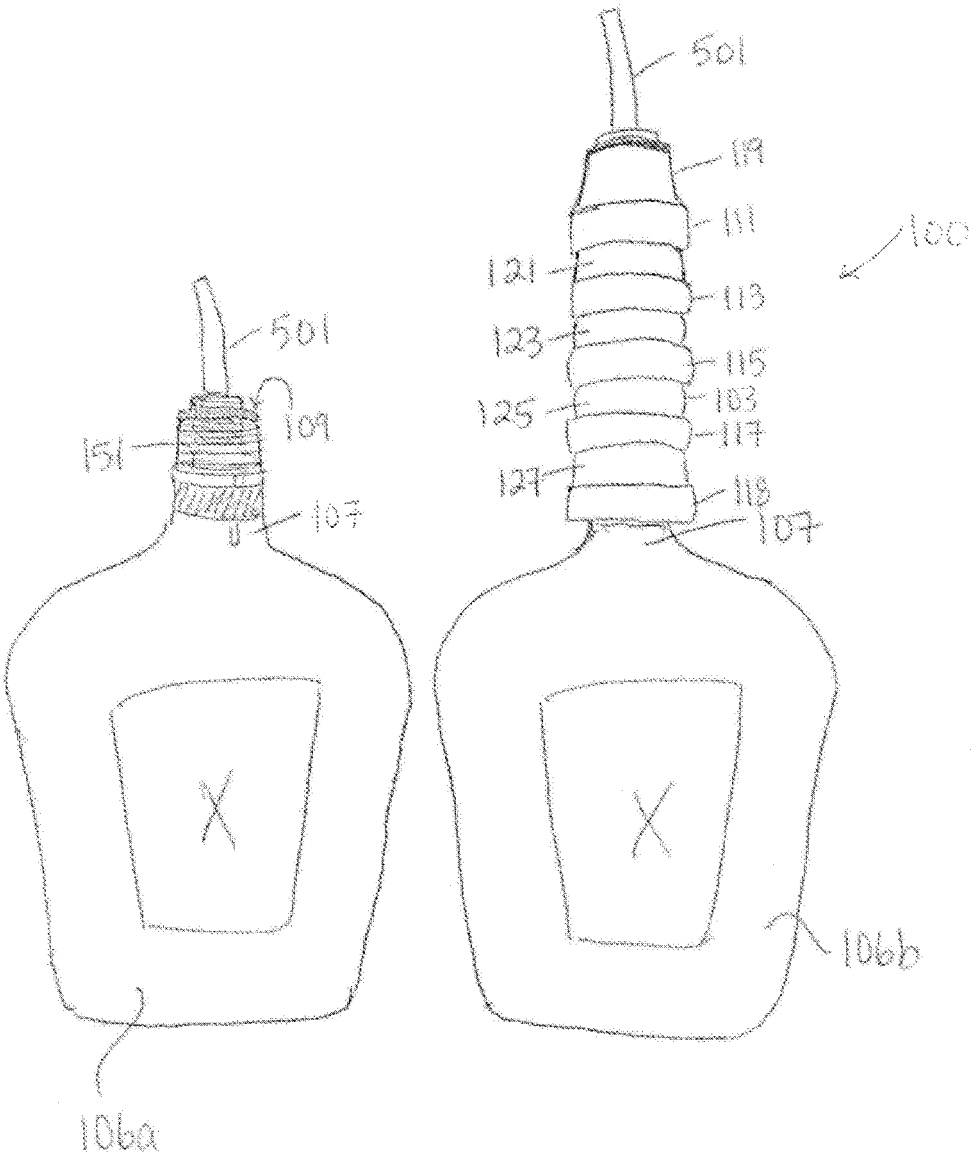
FIG. 7 shows a front view of a first bottle coupled directly with a pour spout and a second bottle having the same configuration as the first bottle coupled with a pour spout via a device according to an exemplary embodiment of the present disclosure.
Figure 8:
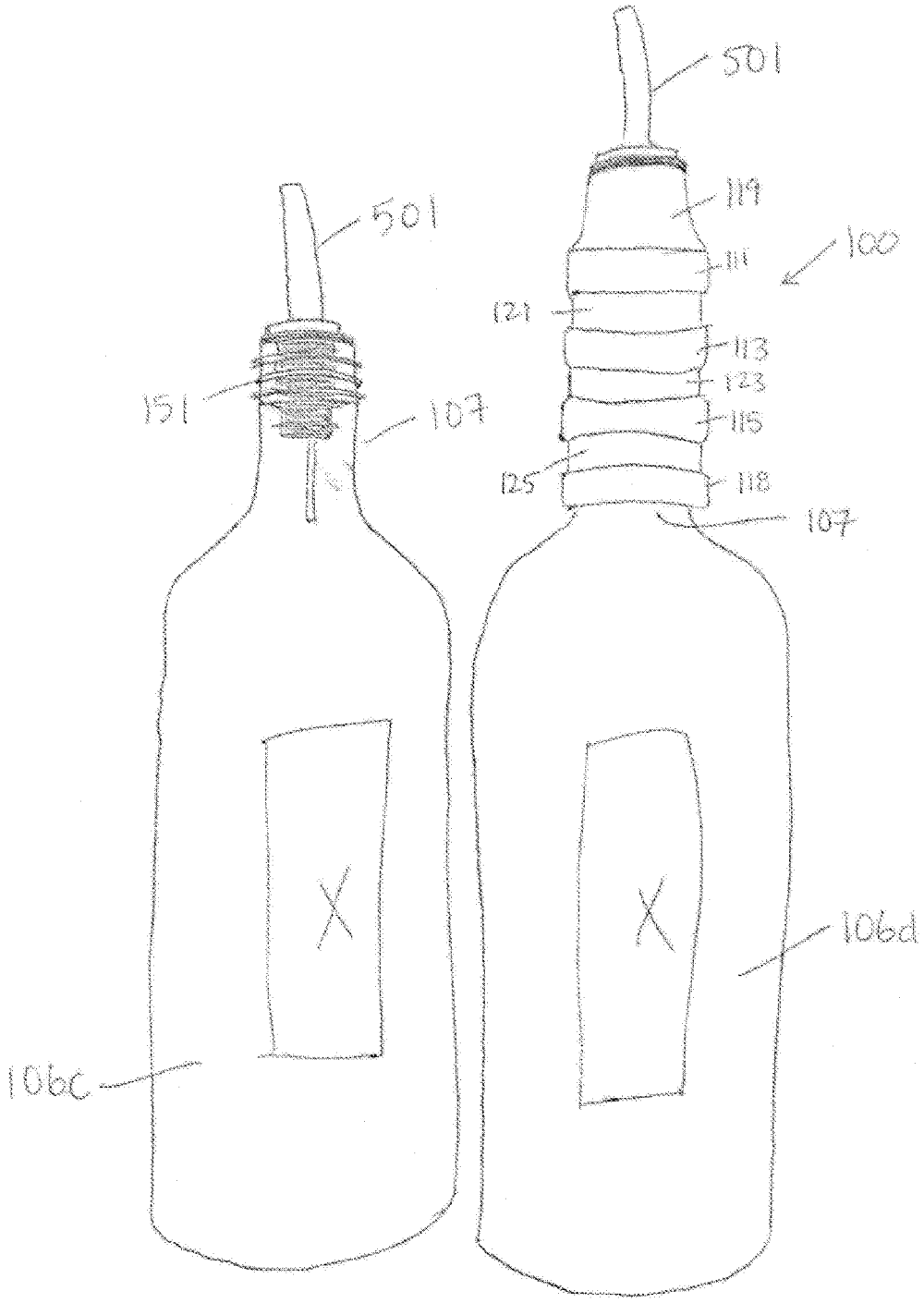
FIG. 8 shows a front view of a first bottle coupled directly with a pour spout and a second bottle having the same configuration as the first bottle, the second bottle coupled with a pour spout via a device according to an exemplary embodiment of the present disclosure.

Now referring to FIGS. 7 and 8, two embodiments of the neck extender device 100 are shown. Perhaps more specifically, FIG. 7 illustrates how the neck extender device 100 may be configured and employed to elongate the neck 107 of a bottle 106. Indeed, as shown in FIG. 7, bottle **106*a* comprises "squat" configuration and has a pour spout 501 coupled with its opening 109 as is known in the art. It will be noted that if bottle 106*a* were positioned on a bar or similar setting amongst other bottles having more elongated configurations, the pour spout 501 would be situated substantially lower than the other bottles. Furthermore, due to the configuration of the bottle 106*a*, there is not a convenient and secure surface where a user can securely grasp the bottle to pour liquid therefrom. While a user may try to finger grip the neck 107 or use his or her hand to pinch the body of the bottle 106*a*, the bottle design is not conducive to a user securely grasping the bottle 106*a*** with his or her whole hand.

On the contrary, while bottle **106*b* comprises the same configuration as bottle 106*a* and is similarly coupled with a pour spout 501 (albeit not directly), bottle 106*b* has the device 100 coupled therewith. In this embodiment, the device 100 is configured to elongate the neck 107 of the bottle 106*b* and, thus, comprises five ribs 111, 113, 115, 117, 118 and five depressions 119, 121, 123, 125, 127 to provide height. FIG. 7 clearly depicts the height difference afforded to the pour spout 501 between bottles 106*a* and 106*b* when the neck extender device 100 is employed in this fashion. In addition to elevating the position of the pour spout 501, the neck extender device 100 provides for a much more graspable surface such that a user can easily and securely grab the neck extending device 100 with his or her whole hand when picking up the bottle 106*b*** to pour. This reduces the stress to the user's hand, wrist and back, as well as provides for a more secure grip.

FIG. 8 illustrates a different, if similar, application of the neck extender device 100. Here, the neck extender device 100 is used less to extend the height of the pour spout 501, and instead more for providing a suitably graspable surface. The bottles **106*c*, 106*d* both configure more elongated configurations. As can be easily seen on bottle 106*c*, the neck 107 of the bottles 106*c*, 106*d* has a length that is much longer than the neck 107 of bottles 106*a*, 106*b* of FIG. 7. Accordingly, in this embodiment, the neck extender device 100 comprises only four ribs 111, 113, 115, 118 and four depressions 119, 121, 123, 125 such that a sufficiently graspable surface is provided, but substantial length is not. Indeed, note that the height difference between bottle 106*c* (without device 100 applied) and bottle 106*d* (coupled with the device 100) is less than that seen between bottles 106*a*, 106*b* of FIG. 7. Furthermore, the neck extender device 100 shown in FIG. 8 is applied to bottle 106*d* such that a large portion of its elongated neck 107 is received within the first end of the body 103. Accordingly, at least the second portion 163 and the second wider aperture 159 may be configured to slidably receive an elongated neck 107 of a bottle therein such that the body 103 of the neck extender device 100 overlaps with the height of the neck 107** and does not have to substantially add to it (unless desired).

Figure 9:
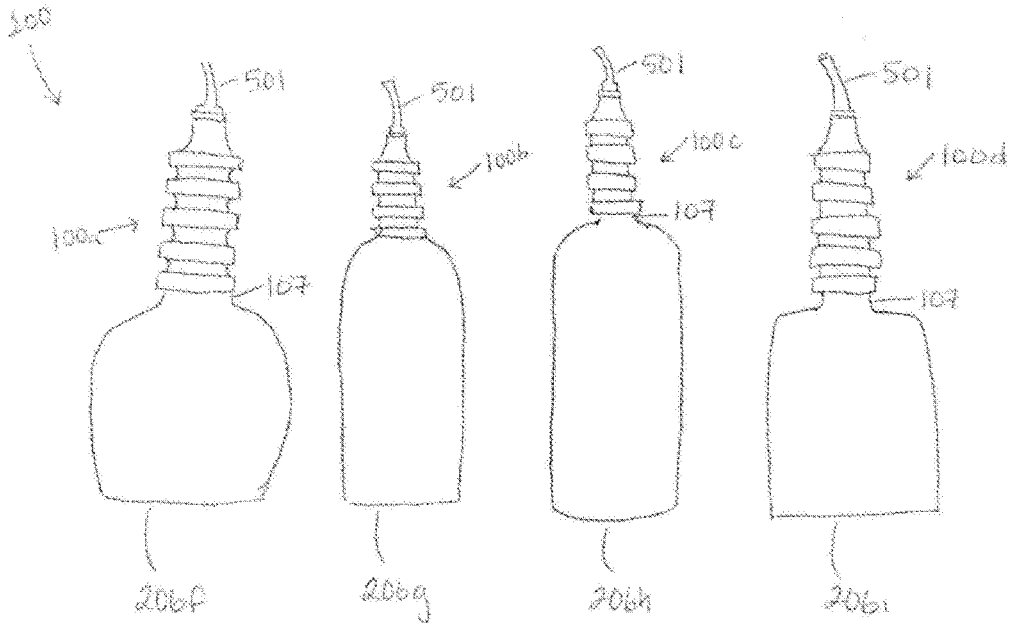
FIG. 9 shows a front view schematic of a system for obtaining uniform container heights according to an exemplary embodiment of the present disclosure.
Figure 10:
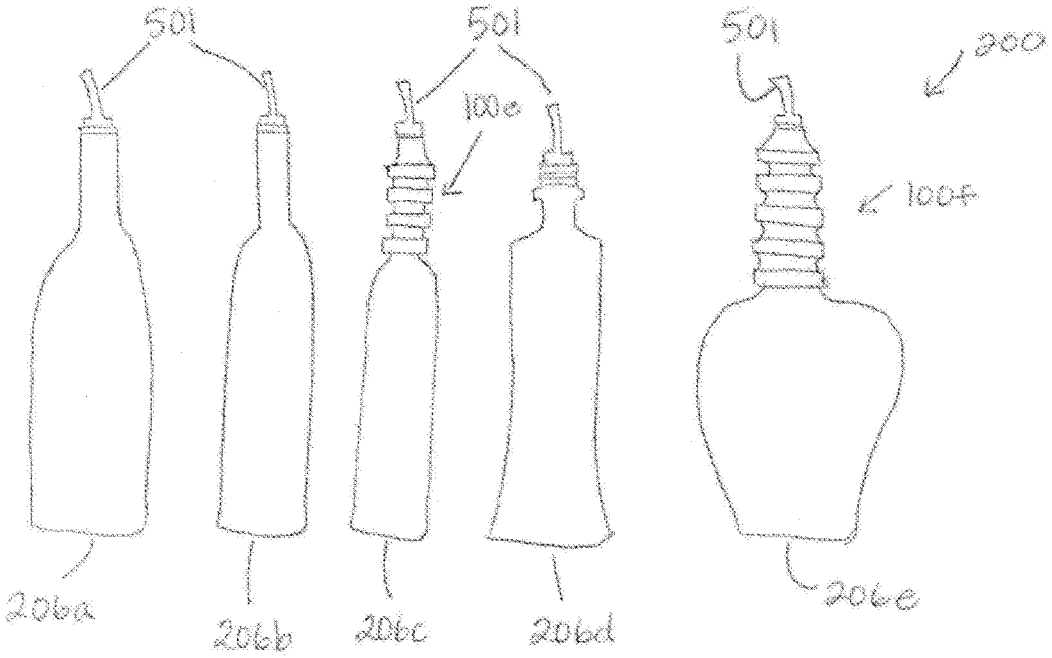
FIG. 10 shows a front view schematic of a system for obtaining uniform container heights according to an exemplary embodiment of the present disclosure.

Now referring to FIGS. 9 and 10, neck extender systems 200 are shown. As previously described, the neck extender devices 100 may be configured to correspond with different bottle configurations. Additionally, the length/configuration of the body 103 of the device 100 may be modified to achieve a desired height of a pour spout 501 coupled therewith.

As shown in FIG. 9, system 200 comprises a first bottle **206*f*, a second bottle 206*g*, a third bottle 206*h*, and a fourth bottle 206*i*, as well as a first neck extender device 100*a*, a second neck extender device 100*b*, a third neck extender device 100*c*, and a fourth neck extender device 100*d*. Additionally, a pour spout 501 is coupled with the second open ends of each of the neck extender devices 100*a*, 100*b*, 100*c*, 100*d***.

In this embodiment (and solely by way of example), the second and third bottles **206*g*, 206*h* comprise similar configurations (the "Elongated Configuration Bottles"), and the first and fourth bottles 206*f*, 206*i* comprise similar configurations (the "Squat Configuration Bottles"). Without the application of the devices 100 thereto, the openings 109 (not shown) of the Elongated Configuration Bottles and the Squat Configuration Bottles would be positioned at different heights such that coupling a pour spout directly therewith would result in pour spouts positioned at varying heights. However, as illustrated in FIG. 9, application of the neck extender devices 100 pursuant to the herein described system 200 result in a substantially uniform height with respect to the position of each pour spout 501 of the various bottles 206***f*, 206*g*, 206*h*, 206*i*. Perhaps more specifically, each neck extender device 100*a*, 100*b*, 100*c*, 100*d* of the system 200 is individually configured (or individually selected from a plurality of devices 100 having various configurations) and/or positioned on its underlying bottle 206*f*, 206*g*, 206*h*, 206*i*, respectively, to achieve a substantially uniform height of the second open ends thereof across the system 200. Furthermore, the body 103 of each neck extender device 100 may additionally comprise one or more distinguishing indicia such that a user can easily ascertain and/or distinguish the contents of the underlying bottles 206*f*, 206*g*, 206*h*, 206*i* simply by glancing at the neck extender devices 100*a*, 100*b*, 100*c*, 100*d*. Such indicia may comprise different symbols and/or colors, for example.

FIG. 10 illustrates at least one alternative embodiment of the system 200 of FIG. 9 further comprising bottles 206*a*, 206*b*, 206*d* that are not coupled with neck extender devices 100. Accordingly, this embodiment of system 200 comprises bottles 206*a*, 206*b*, 206*d* without neck extender devices 100 and bottles 206*b*, 206*e* that are coupled with neck extender devices 100*e*, 100*f* Here, neck extender devices 100*e*, 100*f* are configured to not only engage their corresponding bottles 206*b*, 206*e*, but also such that, when applied to bottles 206*c*, 206*e* (respectively) the pour spouts 501 coupled therewith will be positioned at substantially the same height as those coupled with bottles 206*a*, 206*b*, 206*d*.

As previously noted, if one or more bottles are positioned in a speed well or rack (commonly used devices for serving alcohol and/or drinks in bars and other establishments), the short necks of conventional bottles necessitate that a bartender or other user must bend or lean over to grasp/access the bottles, which places an increased amount of strain on the user's back. Having the graspable surfaces of the bottles at an elevated and relatively uniform height in the well/rack eliminates the need for a user to bend/lean over and thus alleviates this back strain.

Furthermore, when all of the bottles have different heights, any pour spouts coupled thereto will also be at varying heights. This is problematic when a user must reach for a bottle that is shorter than its surrounding bottles as the sharp, metal edges of a pour spout coupled with an adjacent, taller bottle can easily scratch or graze the user's hand or arm. Use of the systems 200, 300 described herein prevents this as all of the graspable surfaces and pour spouts of the bottles are positioned at relatively uniform heights, which substantially reduces the likelihood that a user may scratch his or her hand on a pour spout in reaching for/grasping a bottle.

While embodiments of neck extender and grip promoting devices and systems have been described in considerable detail herein, the embodiments are merely offered by way of non-limiting examples. It will therefore be understood that various changes and modifications may be made, and equivalents may be substituted for elements thereof, without departing from the scope of the disclosure. Indeed, this disclosure is not intended to be exhaustive or to limit the scope of the disclosure.

The invention claimed is:

1. A neck extender and grip promoting device comprising:

a body comprising a first end, a second open end, a central aperture extending from the first end to the second open end, and an exterior surface; and the exterior surface of the body comprises a grip portion to facilitate a secure grip of an entire hand therearound in support of pouring fluid from a container comprising an elongated neck extending from a wider body, the grip portion comprising a first annular rib and a second annular rib, the first annular rib axially spaced apart from the second annular rib;

wherein the second open end of the body sized and shaped to couple with a pour spout therein and the first end of the body defines a first wider aperture and a second wider aperture, each of the first and second wider apertures having a diameter greater than the central aperture;

wherein the first wider aperture is positioned proximally of the second wider aperture and comprises an elongated, cylindrical shape for slidably receiving at least a portion of the elongated neck of the container therein and the second wider aperture comprises at least one female thread to cooperate with a male thread of the container.

2. The neck extender and grip promoting device of claim 1, wherein the grip portion comprises a first depression, the first depression having a curved surface and extending from the first annular rib to the second end of the body and the first wider aperture comprises a diameter that is greater than a diameter of the second wider aperture.

3. The neck extender and grip promoting device of claim 1, wherein the grip portion is integral to the body.

4. The neck extender and grip promoting device of claim 1, wherein the grip portion further comprises a second depression positioned between the first annular rib and the second annular rib.

5. The neck extender and grip promoting device of claim 4, wherein the grip portion further comprises a third rib and a third depression, the third depression positioned between the second rib and the third rib.

6. The neck extender and grip promoting device of claim 5, wherein the grip portion further comprises a fourth rib and a fourth depression, the fourth depression positioned between the third rib and the fourth rib.

7. The neck extender and grip promoting device of claim 1, wherein the each rib of the grip portion extends radially from the periphery of the body.

8. The neck extender and grip promoting device of claim 7, wherein the grip portion further comprises:

one or more depressions, each depression comprising a curved surface and positioned adjacent to at least one of the ribs.

9. The neck extender and grip promoting device of claim 8, wherein one of the depressions is positioned around the periphery of the body and extends from a first rib to the second end of the body.

10. The neck extender and grip promoting device of claim 1, wherein the grip portion comprises a pattern of raised surfaces defining a grip pattern.

11. The neck extender and grip promoting device of claim 1, wherein the exterior surface of the body comprises a tapered configuration such that the radial diameter of the second end is greater than the radial diameter of the first end.

12. The neck extender and grip promoting device of claim 1, wherein the grip portion comprises a compressible material.

13. The neck extender and grip promoting device of claim 12, wherein the compressible material is selected from the group consisting of foam rubber, sponge rubber, synthetic rubber and plastic foam.

14. The neck extender and grip promoting device of claim 1, wherein the container comprises a glass bottle and the fluid comprises a liquor.

15. A system for obtaining uniform container heights, the system comprising:

two or more containers for holding fluid, each of the containers comprising an elongated neck extending from a wider body and a height, and wherein at least two of the containers have different heights and/or sizes; and two or more neck extender and grip promoting devices, each comprising a first end, a second end sized and shaped to couple with a pour spout, a body to facilitate a secure grip of an entire hand around the device and comprising a central aperture, a first wider aperture, and a second wider aperture, the first and second wider apertures each having a diameter greater than the central aperture; and wherein the first wider aperture is positioned proximally of the second wider aperture and comprises an elongated, cylindrical shape for slidably receiving at least a portion of the elongated neck of one of the containers herein and the second wider aperture including at least one female thread to cooperate with a male thread of the container;

wherein the body comprises a first annular rib and a second annular rib, the first annular rib axially spaced apart from the second annular rib; and wherein the neck extender and grip promoting devices are each configured to have a height corresponding with the at least one container to which it is configured to couple and when each neck extender and grip promoting device is coupled with the corresponding container, the resulting extended containers all comprising a substantially uniform height.

16. The system for obtaining uniform container heights of claim 15, wherein each of the two or more neck extender and grip promoting devices comprises an indicium such that when each neck extender and grip promoting device is coupled with a container, the indicium of the neck extender and grip promoting device is indicative of the fluid held in such container.

17. The system for obtaining uniform container heights of claim 15, further comprising one or more containers without a neck extender and grip promoting device coupled therewith, each of such containers for holding fluid and comprising a height that is substantially equivalent to the uniform height.

18. A neck extender and grip promoting device, the device comprising:

a first end configured to couple with an elongated neck extending from a wider body of a bottle, a second open end, and a body extending between the first and second ends, the body comprising a grip portion to facilitate a secure grip of a hand therearound in support of pouring fluid from the bottle, a central aperture in fluid communication with the first and second ends of the device, a first wider aperture comprising an elongated, cylindrical shape for slidably receiving at least a portion of the elongated neck of the bottle therein, and a second wider aperture comprising at least one female thread to cooperate with a male thread of the bottle;

wherein the body is configured to support the bottle when the device is coupled with a bottle and the body is gripped and lifted and the first wider aperture is positioned proximally of the second wider aperture and the grip portion comprises a first annular rib and a second annular rib, the first annular rib axially spaced apart from the second annular rib.

19. The neck extender and grip promoting device of claim 18, wherein the body comprises a substantially cylindrical configuration and the grip portion further comprises a compressible material.

* * * * *